US006352064B1

(12) United States Patent
Tomita et al.

(10) Patent No.: US 6,352,064 B1
(45) Date of Patent: Mar. 5, 2002

(54) ELECTRICALLY CONTROLLED THROTTLE CONTROL SYSTEM

(75) Inventors: Tsugio Tomita, Hitachi; Syuuichi Nakano, Hitachinaka; Koichi Ono, Naka-machi; Mitsuru Watabe, Urizura-machi, all of (JP)

(73) Assignees: Hitachi, Ltd., Tokyo; Hitachi Car Engineering Co., Ltd., Ibaraki, both of (JP)

( * ) Notice: Subject to any disclaimer, the term of this patent is extended or adjusted under 35 U.S.C. 154(b) by 0 days.

(21) Appl. No.: 09/633,896

(22) Filed: Aug. 7, 2000

(30) Foreign Application Priority Data

Aug. 6, 1999 (JP) ..... 11-223417

(51) Int. Cl.[7] ..... F02D 11/10
(52) U.S. Cl. ..... 123/396; 123/399; 123/198 D
(58) Field of Search ..... 123/198 D, 395, 123/396, 397, 398, 399, 361, 376, 377; 73/118.2

(56) References Cited

U.S. PATENT DOCUMENTS 5,447,133 A * 9/1995 Kamio et al. ..... 123/396
5,875,760 A * 3/1999 Bauer et al. ..... 123/397
5,927,251 A * 7/1999 Watanabe et al. ..... 123/399
6,178,947 B1 * 1/2001 Machida et al. ..... 123/396
6,182,635 B1 * 2/2001 Nishida ..... 123/399
6,209,518 B1 * 4/2001 Machida et al. ..... 123/396

* cited by examiner

*Primary Examiner*—Willis R. Wolfe
*Assistant Examiner*—Hai Huynh
(74) *Attorney, Agent, or Firm*—Crowell & Moring LLP

(57) ABSTRACT

Even in such an arrangement in which the throttle valve is operated independently of the engine control system, abnormal engine behavior is ensured to be detected such that a necessary fail-safe operation should be taken. The arrangement of the invention is comprised of the electronically controlled throttle system, engine control system and engine speed monitoring unit, wherein the electronically controlled throttle system is allowed to monitor engine behaviors. Thereby, in the case when the throttle valve is operated independently of the engine control system, if its engine behavior becomes abnormal relative to its drive contents, the engine system senses the abnormality, and takes a fail-safe operation such as to stop operation of the throttle valve and the like.

4 Claims, 5 Drawing Sheets

ELECTRICALLY CONTROLLED THROTTLE CONTROL SYSTEM

BACKGROUND OF THE INVENTION

The present invention relates to a throttle valve control system for opening and closing a throttle valve for use in an automobile by means of an actuator such as a motor or the like.

For an electronically controlled throttle system in which the throttle valve is operated by electronic control, in addition to such a case in which a throttle demand opening is instructed from an engine control system and it operates in response to this instruction, there is another case in which an electronically controlled throttle valve is provided independently of the engine control system for allowing operation by determining a control target position thereof by the electronically controlled throttle system itself. More specifically, there are such cases including: a case for driving its throttle to its close direction or to its open direction in order to learn a minimum position (full close learning) or a maximum position (full open learning); a case for driving its throttle by the steps of reading its acceleration pedal position, obtaining a corresponding throttle opening relative to the value read out from a look-up table or the like; or a case in which the electronically controlled throttle system drives its throttle without instruction from the engine control system when data exchange between the electronically controlled throttle system and the engine control system is interrupted. Because that the engine is driven based on an air flow quantity that is controlled by a throttle opening, and a fuel injection control and an ignition control in which the engine control system is involved, in case where the electronically controlled throttle system itself determines a control target for operation, in order appropriately to execute the fuel injection control, the ignition control and the like, it is necessary for the electronically controlled throttle system and the engine control system to exchange information and control the throttle in collaboration with each other.

For example, in the throttle full close position learning, all that is required is simply to operate the throttle valve until it makes contact with a stopper provided in its close direction, and it is not necessary for the engine to be rotating. In view of safety, it is rather preferable for the engine not working, thereby suppressing fuel injection and the engine should be stopped. In the full open learning, it is necessary for the engine to be controlled not to rotate. Further, in case a throttle opening is to be set up from a position of the acceleration pedal, it is necessary for the electronically controlled throttle system to inform a present position of the acceleration pedal to the engine control system such that the engine control system executes its engine control appropriately in response to the information.

Conventionally, in such a case as above, the electronically controlled throttle system and the engine control system are operated in synchronism with each other, and when the electronically controlled throttle system executes an operation that does not need engine speed, the engine control system is caused to take a measure to stop the engine operation. As a method for synchronizing therebetween, such methods have been utilized as one for taking a necessary step by exchanging contents of operation via a communication line therebetween, or one for monitoring a signal level of its ignition key and synchronizing at a period of timing of a change thereof.

However, as for the electronically controlled throttle system, it is more advantageous to be treated as a one unit and to minimize a relation with other systems, more specifically, interdependency with other systems, because a burden for newly incorporating the electronically controlled throttle system is substantially reduced. However, it should be noted that as described above, there is the case in which the electronically controlled throttle system depends on the behavior of the engine that is controlled by the engine control system.

SUMMARY OF THE INVENTION

An object of the present invention is to reduce an interdependency between the electronically controlled throttle system and the engine control system and improve a system reliability.

An electronically controlled throttle system of the invention monitors behaviors of an engine that is a target of direct control of an engine control system by means of an engine behavior monitor, and executes a fail-safe processing when a predetermined condition is not satisfied. An example of the engine behavior monitor is an engine speed monitor.

More specifically, when the electronically controlled throttle system of the invention controls its throttle independently of the engine control system, monitors engine behaviors using the engine behavior monitor, and if a predetermined condition is not satisfied, executes a fail-safe processing. For example, in the case in which the engine is controlled not to rotate in the step of the full open learning, when the engine behavior monitor that monitors engine speed indicates a value in excess of a predetermined speed, an engine control abnormality is judged to have occurred, and the electronically controlled throttle system terminates the full open learning operation abnormally. An advantage for allowing the electronically controlled throttle system also to monitor the engine behavior in addition to the monitoring and controlling by the engine control system resides in starting the fail-safe processing as quickly as possible and contributing to the improvement in the system reliability.

Because the full close learning or the full open learning are operations that do not require engine operation, there may be a case in which the electronically controlled throttle system and the engine control system are desired to be separated. Even in a state they are separated, in a method in which the electronically controlled throttle system is allowed to monitor the engine behavior, the electronically controlled throttle system is ensured to detect abnormality in the engine behavior and proceed to execute its fail-safe operation.

DESCRIPTION OF THE INVENTION

Preferred embodiments of the invention will be described with reference to the accompanying drawings in the following.

Figure 1:
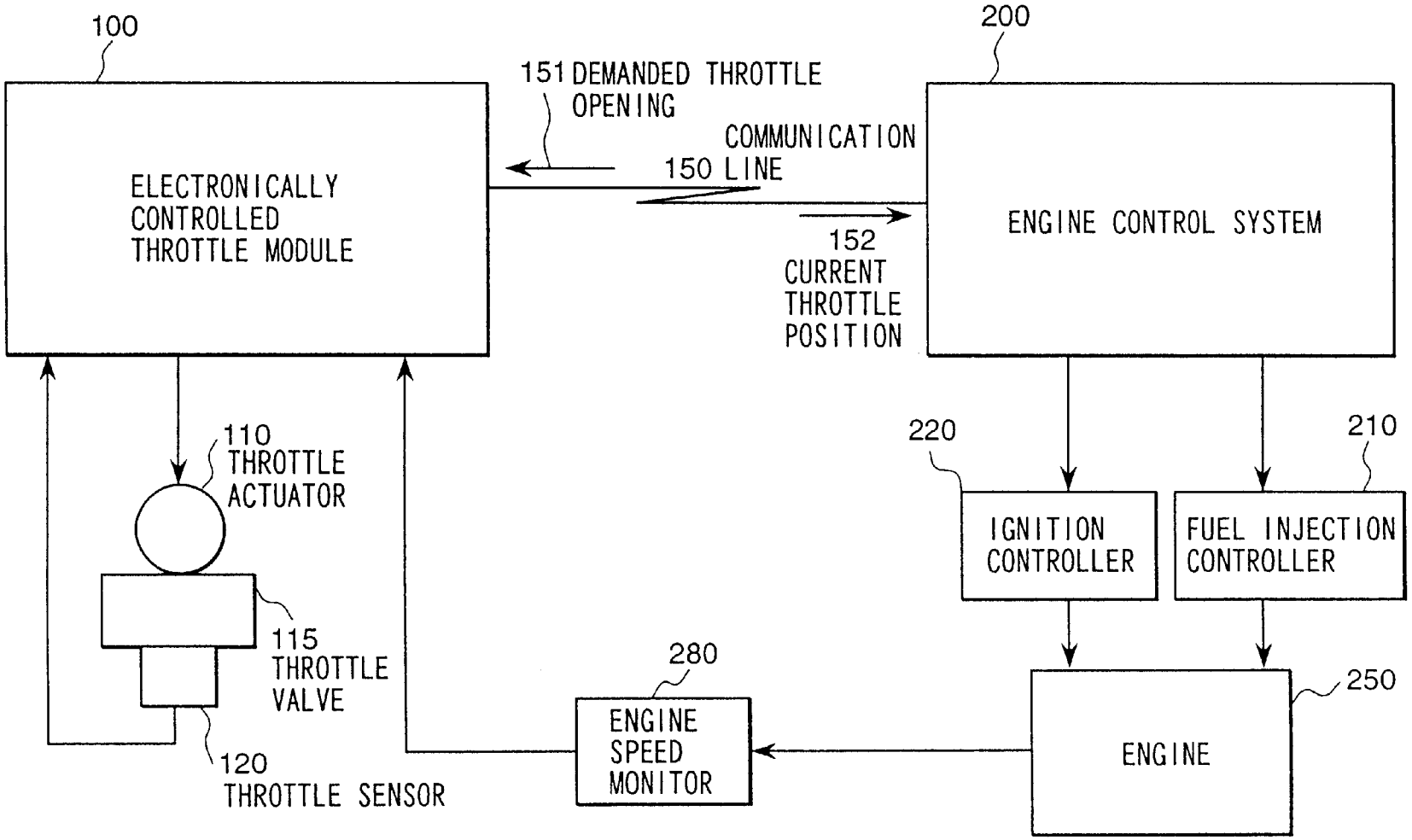
FIG. 1 is a schematic block diagram indicating a first embodiment of the invention.

FIG. 1 is a schematic block diagram indicating a first embodiment of the invention.

An electronically controlled throttle module 100 communicates with an engine control system 200 via a communication line 150, receives a throttle demand opening 151 from engine control system 200 and transmits a throttle's present position 152 to engine control system 200. Further, the same causes a throttle valve 115 to operate by driving a throttle actuator 110. A position of throttle valve 115 is read using a throttle sensor 120 to be used as a feedback signal for driving throttle actuator 110. Engine control system 200 reads an output of an air flow sensor 230, and controls the output of an engine 250 by operating a fuel injection controller 210 and a ignition controller 220. An engine speed that is a typical value for indicating engine behaviors is fed back to the engine control system, and is also read in electronically controlled throttle module 100 via engine speed monitor 280.

The learning of the full close position of throttle valve 115 is executed by the electronically controlled throttle module 100 at the time when the ignition switch is turned on or off, under no throttle opening demand from engine control system 200. Electronically controlled throttle module 100 causes throttle actuator 110 to drive the throttle in the direction of closure, during which, reads values of throttle sensor 120, and sets up a value of throttle sensor 120 which is judged to have reached its minimum as a learned full closure value. At this stage, electronically controlled throttle module 100 notifies engine control system 200 completion of the full close position learning via communication line 150. Until the notification of the completion of the full closure learning from electronically controlled throttle module 100, engine control system 200 does not drive fuel injection controller 210 and ignition controller 220, and upon notification thereof, drives fuel injection controller 210 and ignition controller 220 to start the engine control operation.

In the process of the full closure learning by electronically controlled throttle module 100, if engine control system 200 misjudges that the electronically controlled throttle module 100 does not execute the full closure learning, the engine control system 200 attempts to control engine 250 by operating fuel injection controller 210 and ignition controller 220, however, because that throttle valve 115 is driven to its full closure position, there is a probability for the engine 250 to become in a state of engine stall. At this moment, in the case in which a full open learning is to be executed, its engine speed increases with opening of throttle valve 115 in such a case as above. However, according to the invention, because electronically controlled throttle module 100 monitors the revolution of engine 250 via engine speed monitor 280, when it senses an increase in the engine speed, interrupts its full open learning and closes throttle valve 115, thereby capable of suppressing the output of engine 250.

In the case described above, when engine speed monitoring unit 280 malfunctions, the state of the engine 250 cannot be known. Therefore, according to the invention, its full open learning is interrupted in the same way as in the case where the engine speed monitoring unit 280 operates normally and an increase in the engine speed is sensed. Malfunctioning of engine speed monitor 280 probably occurs due to a short-circuit or open-circuit of wiring, and can be detected by a change in the output level of engine speed monitor 280.

The foregoing description has been made by way of examples of the full close and the full open learning operations, however, it may also be applied to a case in which a throttle return spring is to be checked. When the throttle control becomes abnormal, throttle valve 115 stops the motor drive as a fail-safe procedure. A return spring is provided for ensuring the throttle valve to return to a predetermined position (a default position) at this instant. The default position is set, not at the full closure position, but mostly at a position at which the throttle valve 115 is slightly open. This is because of ensuring that even if the motor drive is stopped as the fail-safe procedure under abnormality of the throttle control, the vehicle may be moved at least to a safety position. In order to allow for the throttle valve 115 to be moved to a predetermined position at the time when the motor drive is stopped, two kinds of throttle return springs are used for urging throttle valve 115 into both directions of an open and a closure directions. Diagnosis of these two springs whether or not they function normally is done by observation that throttle valve 115 returns to its default position from its full open position and full close position after it is driven thereto, and then the motor drive is stopped. Also, in the diagnosis of this operation, this embodiment of the invention is applicable.

Figure 2:
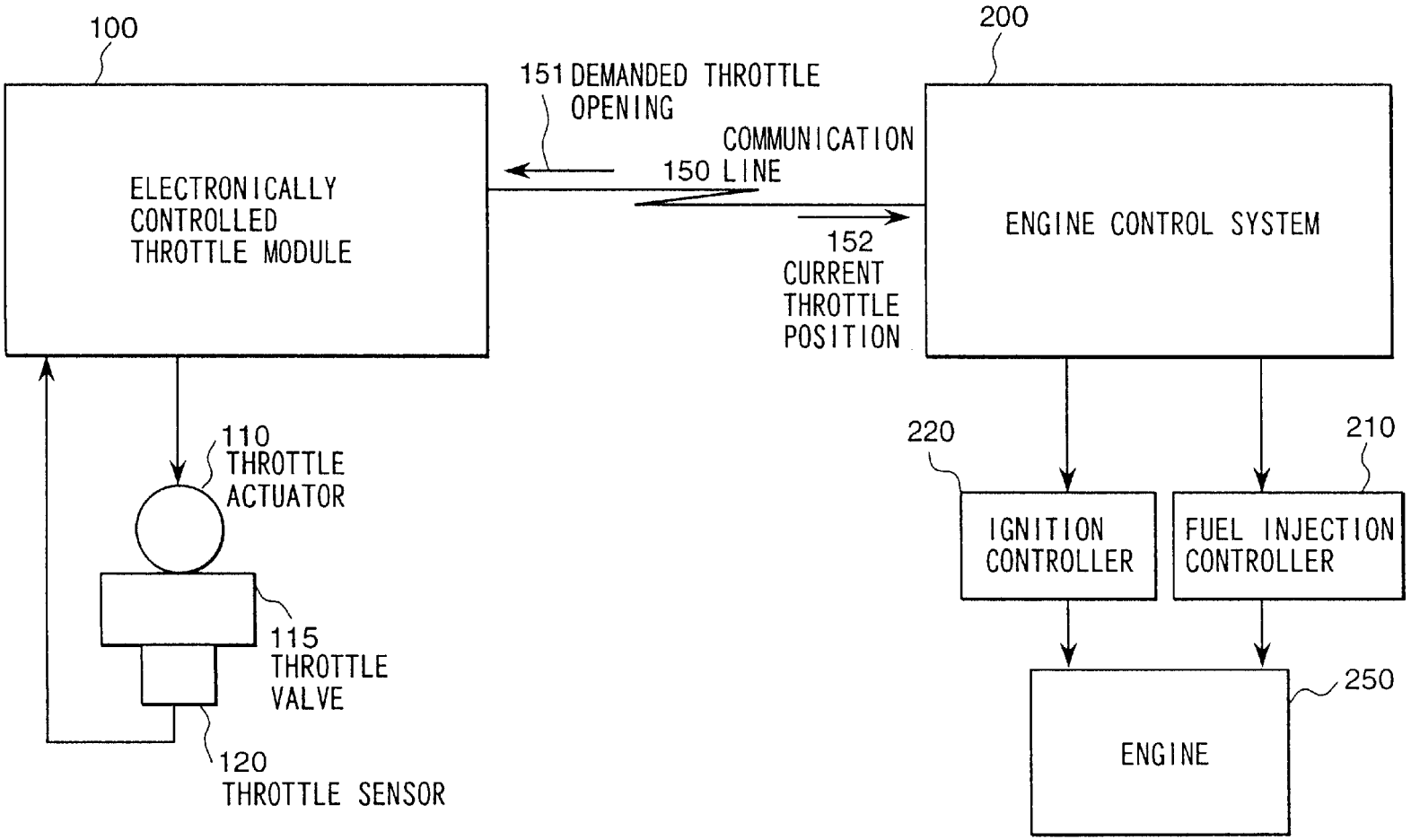
FIG. 2 is a schematic block diagram indicating a second embodiment of the invention.

A second embodiment of the invention is indicated in FIG. 2, in which engine speed monitor 280 indicated in FIG. 1 of the first embodiment of the invention is eliminated, and instead thereof, its engine speed is notified from engine control system 200 to electronically controlled throttle module 100 via communication line 150. In the electronically controlled throttle module 100, only a means for knowing its engine speed is changed, and its operating principle is the same as in the case of FIG. 1. Further, such a case in which the electronically controlled throttle module 100 fails to learn the engine speed due to abnormality in communication line 150 corresponds to the case of malfunctioning of engine speed monitor 280 described with reference to FIG. 1.

Figure 3:
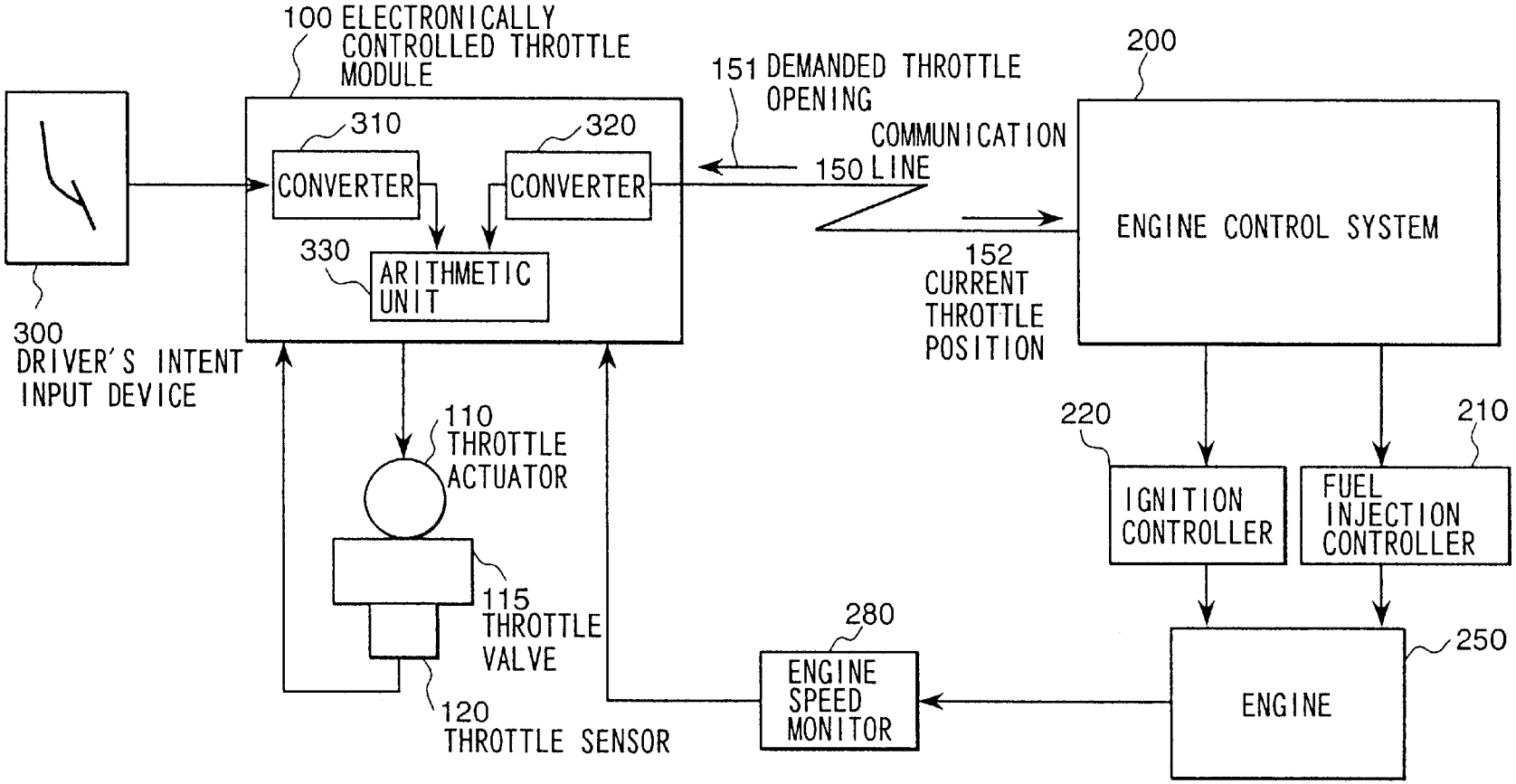
FIG. 3 is a schematic block diagram indicating a third embodiment of the invention.

A third embodiment of the invention will be described with reference to FIG. 3. A driver's intent input device 300 is typically represented by an acceleration pedal, and when the driver operates the pedal, it outputs a value in response to its control quantity. Electronically controlled throttle module 100 reads an output value from driver's intent input device 300, and obtains a first throttle target opening by means of a driver's intent/throttle opening converter 310. Further, an engine control demand opening converter 320 calculates a second throttle target opening on the basis of the throttle demand opening value received from engine control system 200 via communication line 150. A final throttle target opening arithmetic unit 330 adds the first throttle target opening and the second throttle target opening, and drives throttle actuator 110 in accordance with a value obtained as a result of addition.

In the process of receiving a throttle demand opening value from engine control system 200 via communication line 150 according to this embodiment of the invention, it may be considered that the throttle demand opening value cannot be received properly due to a failure such as open circuit, short circuit, or by noise. In such cases, according to this embodiment of the invention, a predetermined value is used as a throttle demand opening value.

Figure 4:
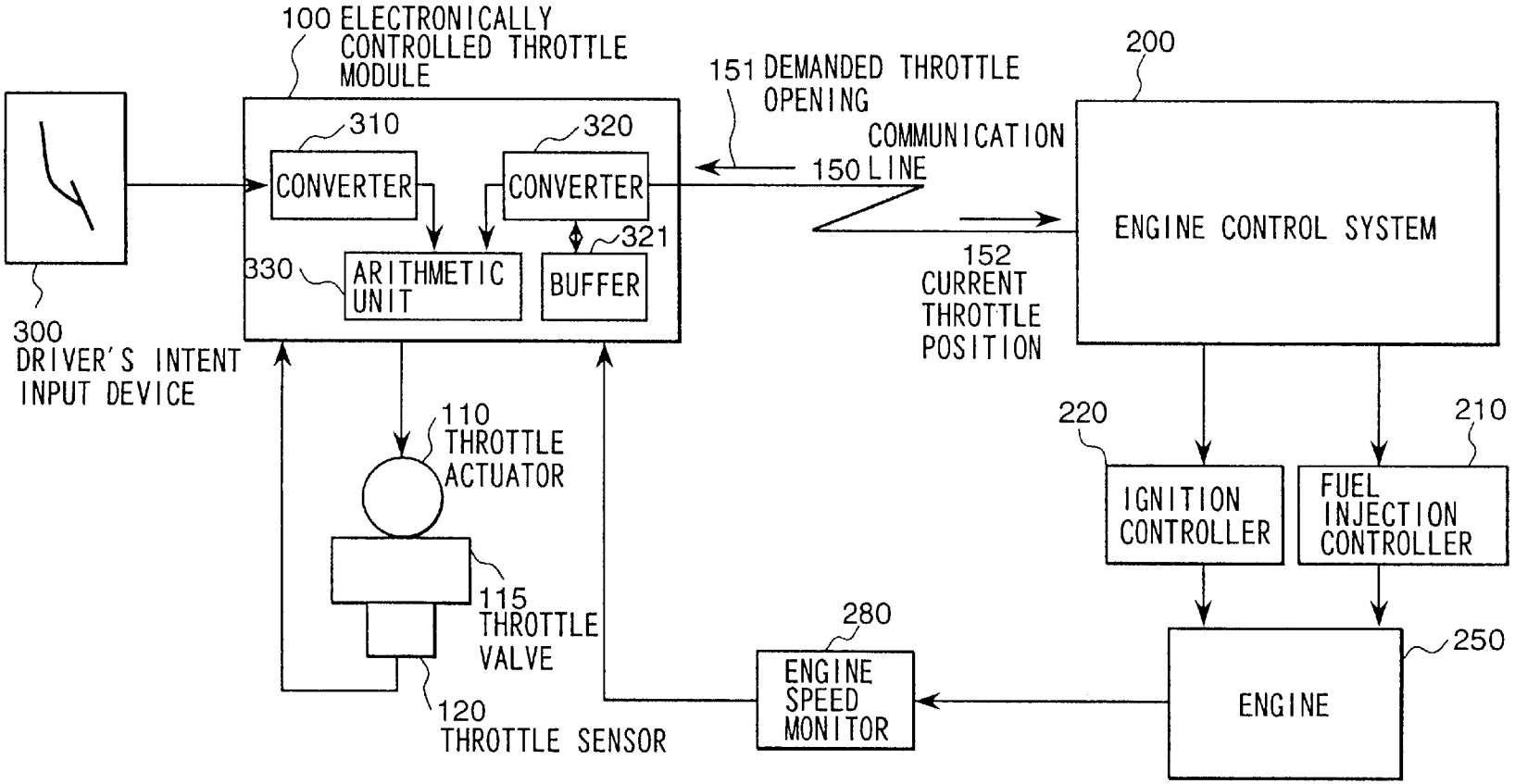
FIG. 4 is a schematic block diagram indicating a fourth embodiment of the invention.

A fourth embodiment of the invention, which is a modification of the third embodiment above, will be described with reference to FIG. 4. In this embodiment of the invention, a throttle demand opening buffer 321 is added to in comparison with the configuration of FIG. 3. Engine control demand opening converter 320, everytime it calculates a second throttle target opening on the basis of the throttle demand opening value received from engine control system 200 via communication line 150, stores a result of its calculation in throttle demand opening buffer memory 321. In case electronically controlled throttle module 100 is unable to receive the throttle demand opening value properly, a second throttle target opening value is calculated on the basis of the values stored in throttle demand opening buffer memory 321. At this time, as methods of the above calculation, there are such ones as follows. Simply to continue to use the value stored in throttle demand opening buffer 321, to use a value which is obtained by subtracting a predetermined value from the value stored in throttle demand opening buffer memory 321, or to change the value to be used along a curve predetermined relative to the value stored in throttle demand opening buffer 321.

Figure 5:
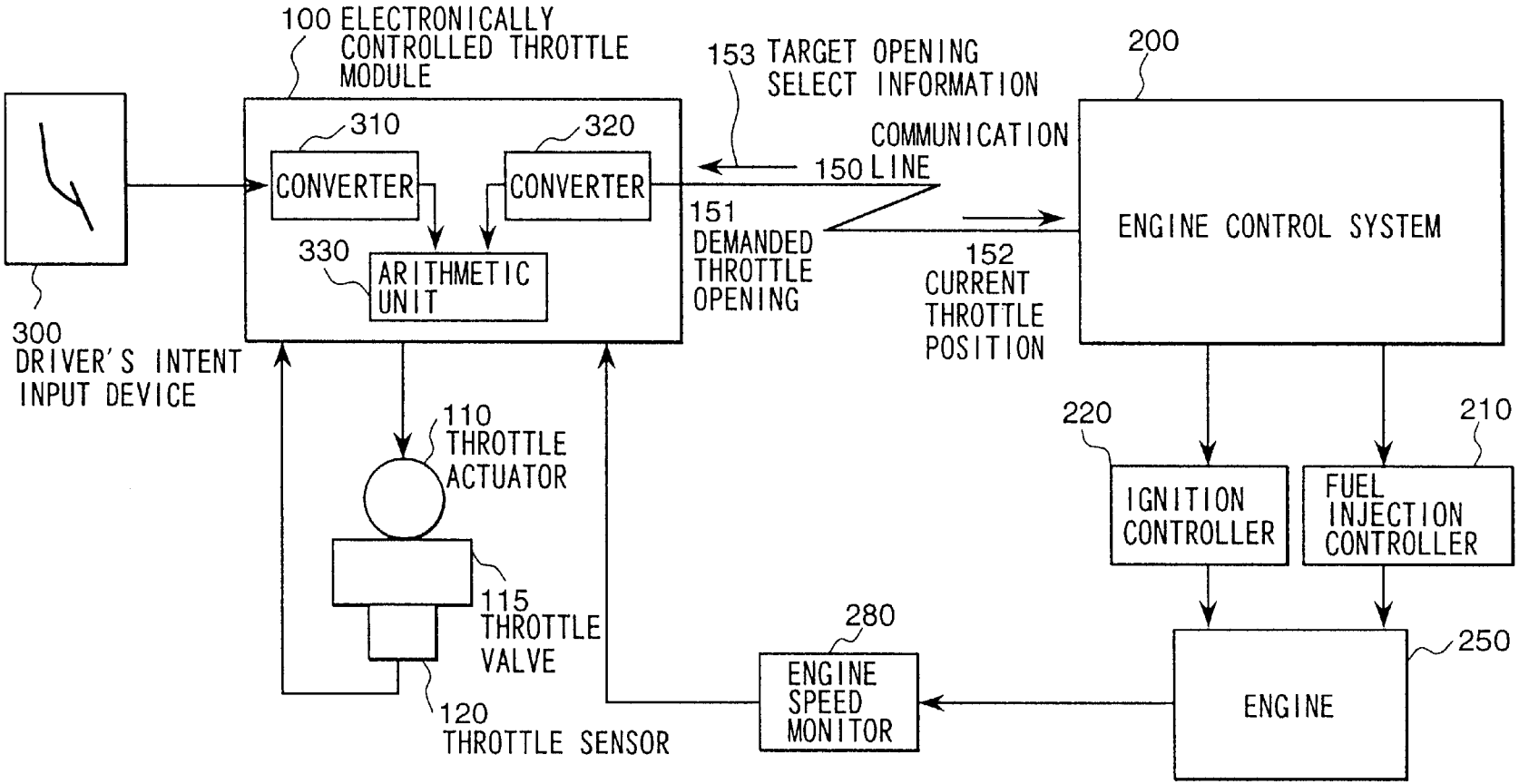
FIG. 5 is a schematic block diagram indicating a fifth embodiment of the invention.

A fifth embodiment of the invention will be described with reference to FIG. 5. In this embodiment of the invention, a target opening select information 153 is received from engine control system 200. Target opening select information 153 is either value of 1, 2 and 3, and each of which means as follows.

1: its final throttle target opening is to be obtained by addition of values of the first throttle target opening and the second throttle target opening, 2: its final throttle target opening should be the first throttle target opening, and 3: its final throttle target opening should be the second throttle target opening.

A case where its target opening select information 153 is "1" corresponds to a normal case; another case where its target opening select information 153 is "2" corresponds to a case in which an output from driver's intent input device 300 is to be disregarded, wherein its throttle is controlled in accordance with the first throttle target opening requested by engine control system 200 even if the acceleration pedal is not pressed, which corresponds to a case of a cruising state; and the remaining case where its target opening select information 153 is "3" corresponds to a case in which the first throttle target opening received from engine control system 200 is to be disregarded, wherein the second throttle target opening that is calculated on the basis of the throttle demand opening value received from engine control system 200 via communication line 150 is disregarded due to detection of abnormality in communication with engine control system 200, even if the communication therebetween is recovered, thereby operating throttle valve 115 only according to a value read from driver's intent input device 300.

According to the invention, even in such a case where the throttle valve is operated independently of the engine control system, it is enabled to detect occurrence of abnormality in the engine and execute a necessary fail-safe procedure.

What is claimed is:

1. An engine equipment including an electronically controlled throttle system and an engine control system, further comprising an engine behavior monitoring unit for monitoring engine behaviors, wherein said electronically controlled throttle system, when the same operates a throttle to open or close without an instruction of throttle demand opening from said engine control system, analyzes a result of monitoring by said engine behavior monitoring unit, and if its engine behavior is judged to be abnormal from a deviation from a predetermined normal range of behaviors, executes a predetermined fail-safe procedure.

2. An engine equipment including an electronically controlled throttle system and an engine control system, further comprising an engine behavior monitoring unit for monitoring engine behaviors, wherein said electronically controlled throttle system, when the same operates a throttle to open or close without an instruction of throttle demand opening from said engine control system, and if a result of monitoring the engine behaviors by said engine behavior monitoring unit is abnormal, executes a predetermined fail-safe procedure.

3. An engine equipment including an electronically controlled throttle system and an engine control system, said engine control system comprising a built-in function to monitor engine behavior and notify a result of monitoring to said electronically controlled throttle system, wherein when said electronically controlled throttle system operates a throttle to open or close without an instruction from said engine control system, and if an abnormality is judged to have occurred on the basis of engine behavior information notified from said engine control system and from a deviation of said engine behavior from a predetermined range of behaviors, said electronically controlled throttle system executes a predetermined fail-safe operation.

4. An electronically controlled throttle system according to claim 3, wherein said electronically controlled throttle system executes a predetermined fail-safe operation when said engine behavior information to be notified from said engine control system fails to be received.

* * * * *